US005678861A

United States Patent [19]

Werner

[11] Patent Number: 5,678,861

[45] Date of Patent: Oct. 21, 1997

[54] SYSTEM FOR BINDING SHEET LIKE ARTICLES

[76] Inventor: Richard S. Werner, 326 Cedar Sauk Rd., West Bend, Wis. 53095

[21] Appl. No.: 683,803

[22] Filed: Jul. 18, 1996

Related U.S. Application Data

[63] Continuation of Ser. No. 298,781, Aug. 31, 1994, abandoned, which is a continuation-in-part of Ser. No. 231,425, Apr. 22, 1994, abandoned.

[51] Int. Cl.[6] ..... B42D 1/00

[52] U.S. Cl. ..... 281/21.1; 281/28; 412/33

[58] Field of Search ..... 281/21.1, 28, 29; 412/8, 33; 156/227

[56] References Cited

U.S. PATENT DOCUMENTS

| | | | |
|---|---|---|---|
| 848,680 | 4/1907 | Nelson | 281/21.1 |
| 1,765,194 | 7/1930 | Von Auw | 281/21.1 |
| 1,843,771 | 2/1932 | Kiine | 281/28 X |
| 2,372,115 | 3/1945 | Perry, Jr. | 281/21.1 |
| 2,387,808 | 10/1945 | Pruneau et al. | 281/21.1 |
| 2,455,971 | 12/1948 | Bosch | 281/21.1 |
| 2,557,190 | 6/1951 | Jolly | 281/28 X |
| 3,133,750 | 5/1964 | Gerald | 281/34 |
| 3,188,114 | 6/1965 | O'Brien et al. | 412/901 |
| 3,210,093 | 10/1965 | Steidinger | 281/21.1 |
| 3,212,505 | 10/1965 | Toman | 281/21.1 |
| 3,215,450 | 11/1965 | Peterson et al. | 281/29 |
| 3,241,863 | 3/1966 | Paddack | 402/3 |
| 3,620,891 | 11/1971 | Jones, Sr. et al. | 281/21.1 |
| 3,825,963 | 7/1974 | Abilgaard et al. | 412/21 |
| 3,833,244 | 9/1974 | Heimann | 281/21.1 |
| 3,891,240 | 6/1975 | DuCorday | 281/29 |
| 3,912,304 | 10/1975 | Abildgaard et al. | 281/21.1 |
| 4,083,582 | 4/1978 | Villafana | 281/20 |
| 4,441,950 | 4/1984 | Lolli | 281/21.1 |
| 4,500,021 | 2/1985 | Bildusas | 428/40 |
| 4,518,296 | 5/1985 | Pearson et al. | 281/21.1 |
| 4,636,432 | 1/1987 | Shibano et al. | 428/536 |
| 4,673,324 | 6/1987 | Hanson et al. | 412/6 |
| 4,744,592 | 5/1988 | Barnette et al. | 281/29 |
| 4,762,341 | 8/1988 | Rabuse | 412/8 |
| 4,800,110 | 1/1989 | DuCorday | 281/21.1 |
| 4,941,791 | 7/1990 | Iwamoto . | |
| 5,052,872 | 10/1991 | Hunder et al. | 281/21.1 X |
| 5,226,676 | 7/1993 | Su | 281/28 X |

FOREIGN PATENT DOCUMENTS

| | | | |
|---|---|---|---|
| 0535531 | 5/1958 | Italy | 281/21.1 |

*Primary Examiner*—Larry I. Schwartz
*Assistant Examiner*—Khan V. Nguyen
*Attorney, Agent, or Firm*—Jansson & Shupe, Ltd.

[57] ABSTRACT

A system is disclosed for binding together sheet-like articles such as photos or documents. The system includes a back cover, a front cover and a spine member attached to one cover. Such spine member has an "edge-binding" medial portion and a cover-adhering strip. Such strip attaches to the other cover after the articles are placed between the covers for binding. The cover-adhering strip and the medial portion (both overlaid with a protective release liner removed just prior to strip use) are divided by a lateral cut into at least two portions. With one hand, a user of the system may securely hold the covers and articles aligned and using the other hand, remove the release liner and in sequence, fold over the slit-divided medial portion and the strip portion to contact the article edges and the other cover, respectively. The system adheres to and secures the articles and the covers together. A method for binding sheet-like articles is also disclosed.

5 Claims, 5 Drawing Sheets

FIG. 1
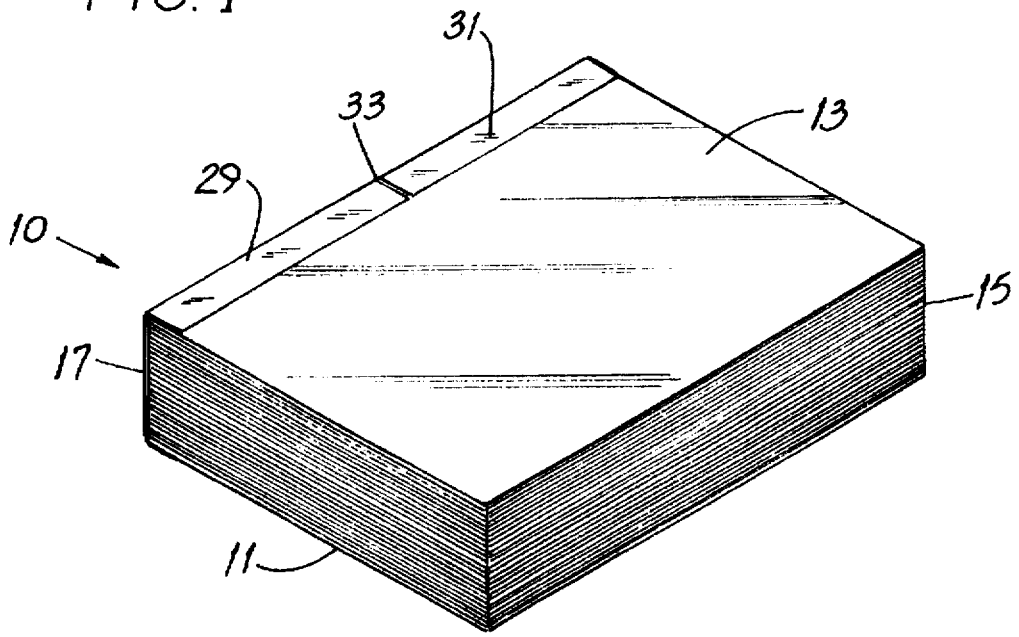
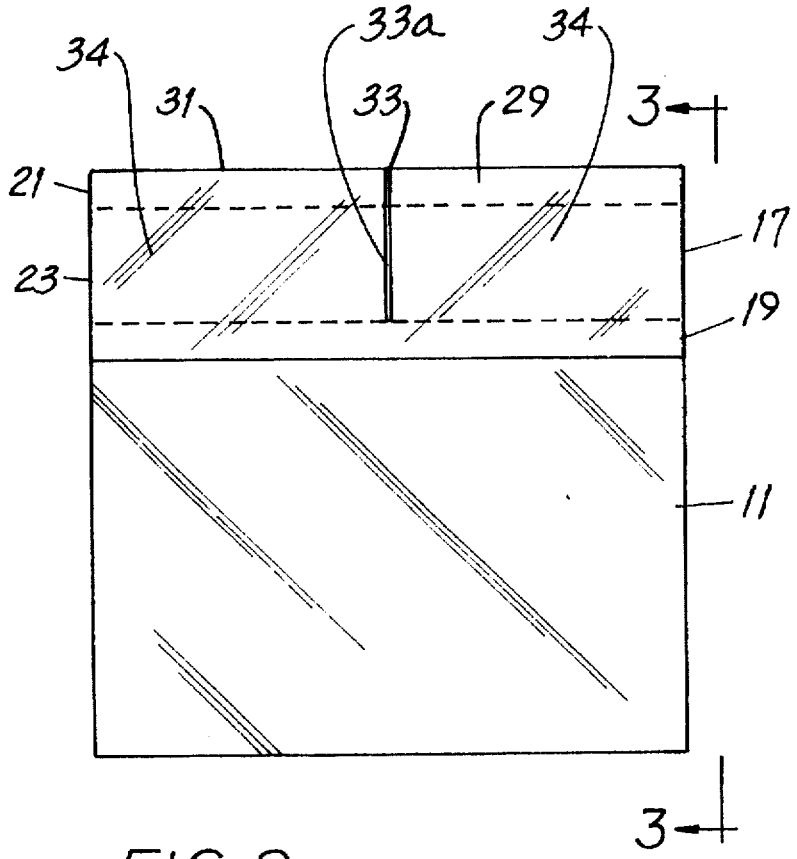
FIG. 2
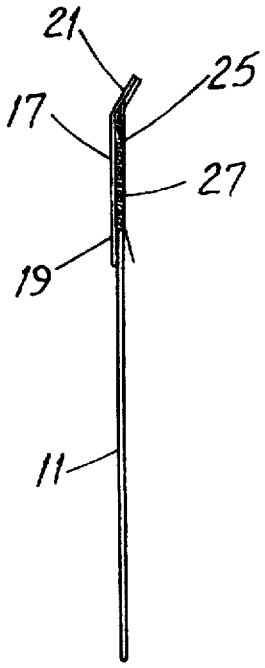
FIG. 3

FIG. 6
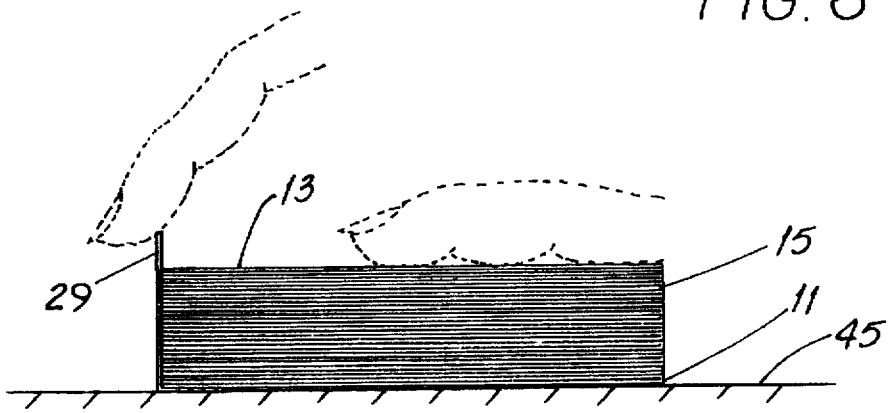
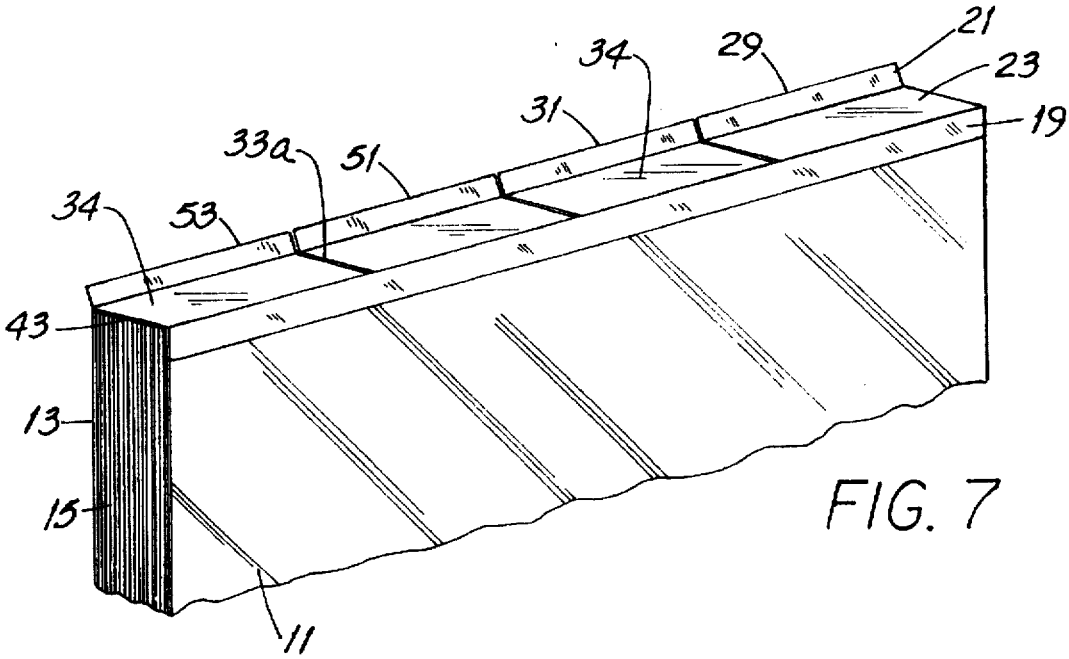
FIG. 7
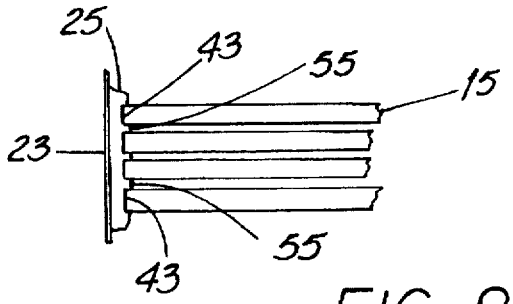
FIG. 8

FIG. 9
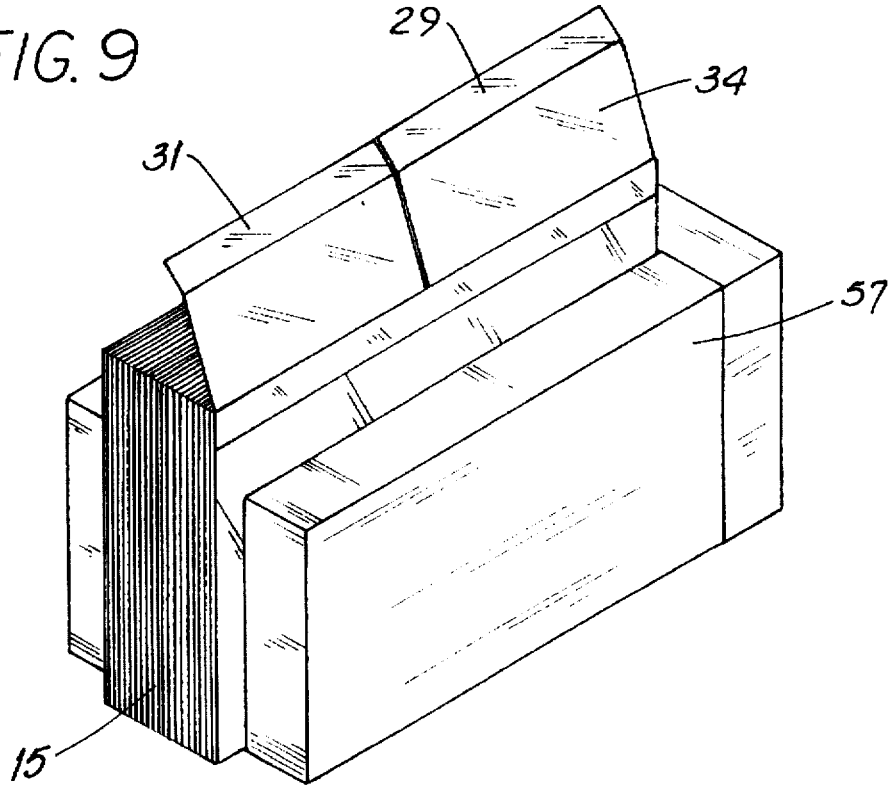
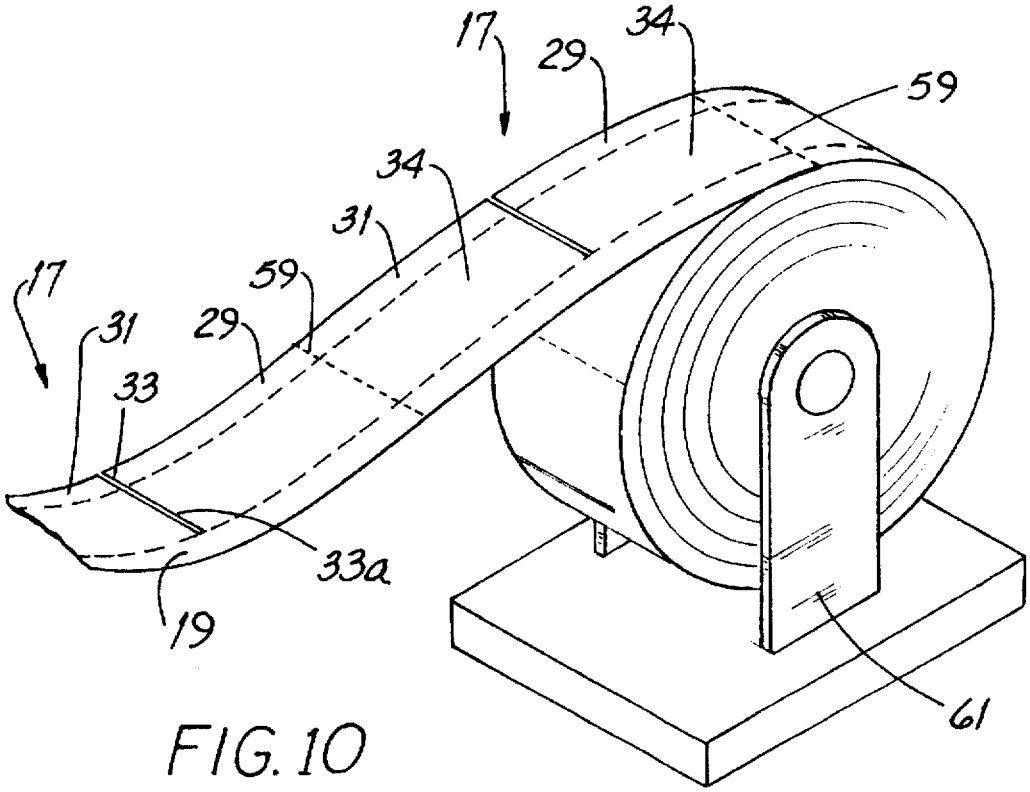
FIG. 10

SYSTEM FOR BINDING SHEET LIKE ARTICLES

RELATED APPLICATIONS

This application is a continuation of application Ser. No. 08/298,781 filed on Aug. 31, 1994, and now abandoned, which in turn is a continuation-in-part of application Ser. No. 08/231,425 filed on Apr. 22, 1994, and now abandoned.

FIELD OF THE INVENTION

This invention relates generally to bookbinding and, more particularly, to binding using adhesives.

BACKGROUND OF THE INVENTION

Binding together of sheet-like articles such as pages of a book may be accomplished in a number of ways. Some are relatively complex and require machinery. Of course, commercial bookbinders (for either new books or books under repair) usually employ such machinery and pages are permanently bound in the book.

On the other hand, there are situations where it is desirable to bind sheet-like articles together but acquisition of bookbinding machinery is out of the question or at least not warranted. For example, persons who take or otherwise obtain candid photographs often find it desirable to bind such photos between covers to form a book-like arrangement.

Such an arrangement protects the photos, helps prevent loss and retains the order of arrangement. The latter may be important in, say, describing a sequence of events such as a vacation trip. U.S. Pat. No. 4,941,791 (Iwamoto) depicts a binder said to be useful to hold together post cards, photos, business cards and the like.

But photographs are not the only type of sheet-like article to be bound together in aligned, stacked arrangement. U.S. Pat. Nos. 848,680 (Nelson); 1,765,194 (Von Auw); 3,188,114 (O'Brien et al.) and 4,673,324 (Hanson et al.) all depict ways to bind together other types of such articles, e.g., writing tablet sheets, business forms and the like.

While the prior art arrangements have been generally suitable for their intended purposes, some tend to be characterized by certain disadvantages. This is particularly true with respect to self-applied, pressure-adhering devices used by "amateur binders," e.g., persons wishing to bind photos of their grandchildren.

Unlike instances where machinery is employed to secure sheets for and during binding, the self-applied binders (such as that shown in the Iwamoto patent) are very tricky to use. One must stack and carefully align the articles, e.g., documents or photos, and while holding them in precise arrangement between a pair of covers, neatly and squarely apply a self-adhering strip along the aligned edges of the articles to be bound together.

Even though the strip may be "pre-attached" to one of the covers and need only be adhered to the other, this task requires a good deal of manual dexterity and is not easily accomplished. And if one's ability to securely "clamp" a stack of articles together is a bit impaired, this adds another dimension of complexity.

Two common (and related) "flaws" can occur. One is that the strip is "out of square" when applied and does not fully contact and secure one of the covers. The other is that because the strip is not straight along the aligned edges, the strip has a fold or crease along it and does not contact and secure the articles to be bound as well as possible. Even disregarding the fact that "components" of the articles and binder may not be as well secured as possible, the arrangement is aesthetically less pleasing that it might be.

It has been found that a primary cause of such flaws is that the length of the self-adhering strip is often too long to manage with only one hand while the other hand continues to grasp or otherwise hold the stack in alignment. Even with articles like photos, binding problems occur. And as the articles become larger (or at least where the corresponding edge of the article become longer), flawed binding becomes more likely. A new system which addresses some of these disadvantages would be an important advance in the art.

OBJECTS OF THE INVENTION

It is an object of the invention to provide a system and method for binding sheet-like articles which overcomes some of the problems and shortcomings of the prior art.

Another object of the invention is to provide a system and method for binding sheet-like articles wherein the resulting "assembly" more positively retains such articles.

Another object of the invention is to provide a system and method for binding sheet-like articles which more firmly secures the covers protecting such articles.

Still another object of the invention is to provide a system and method for binding sheet-like articles which results in an aesthetically-pleasing finished binding.

Another object of the invention is to provide a system and method for binding sheet-like articles which may be adapted to documents having any of a wide variety of edge dimensions. How these and other objects are accomplished will become more apparent from the following descriptions and from the drawing.

SUMMARY OF THE INVENTION

The invention involves a system for binding sheet-like articles such as candid photographs, documents and the like. The system has a back cover, a front cover and an elongate, strip-like spine member which, preparatory to final binding, adheres to only one of the covers.

In the improvement, the spine member has a cover-adhering strip, i.e., that strip which is folded over to finally "assemble" the front and back covers and a-stack of articles. Such strip is divided into at least two portions by one or more lateral cuts or slits in the strip.

The spine member also has another cover-adhering strip and an "edge-adhering" medial portion between the strips. In a highly preferred arrangement, there is a medial slit which divides the medial portion into two segments. The slits dividing the cover-adhering strip and the medial portion are co-extensive with one another.

After placing the articles between the covers and aligning the covers and articles preparatory to final binding, the user holds the covers and articles in alignment by grasping them with one hand. Or, in the alternative, such covers and articles can be placed atop a flat surface and pressed with one hand. Using-the other hand, the slit-separated segments and the slit-separated portions of the cover-adhering strip are folded over and applied in sequence to the other cover, thus completing binding. When binding is complete, such spine member adheres to and secures the articles and the covers together.

Yet another way to use the system is in conjunction with a slotted holding receptacle. The covers and the articles are placed in such receptacle and using one or both hands, the medial segments and the strip portions are applied as described above.

A particular use for the system is with photographs, especially candid photos. Such photos have substantially the same dimension along an edge and the strip has a pair of ends spaced apart by about the same dimension. The strip is divided into easily-applied portions by a cut or slit at a location about midway between the ends.

To help protect the strip from inadvertently sticking to some object other than the intended binder cover, the strip has a release liner adhering to it. The length of the release liner is about equal to the underlying strip and, preferably, the release liner has a "free" tab, i.e., a small part overlaying that cover to which the strip is attached prior to final binding. Such tab does not adhere to the strip. When the system is ready to use, the tab is easily grasped and the liner readily removed from the strip. If the release liner is divided into two or more portions (each coextensive with a corresponding portion of the strip), the tab of each release liner section is individually grasped and each such section is readily removed from the strip.

The system is also very useful for binding documents which are larger than candid photos and which have commonly-aligned edges. Such documents may be 8½ inches by 11 inches in size, for example. In that instance, the strip is divided into at least three portions extending generally parallel to the edges aligned for binding. In that way, each adhering portion is sufficiently short to be easily manageable with one hand. A portion length of about three inches is preferred.

And that is not all. The spine members may be put up in roll-like form and used with a dispenser. In that arrangement, the spine members are attached to one another in end-abutting relationship and mounted on a dispenser much like a ticket dispenser for easy and immediate access.

Other aspects of the invention include a method for binding sheet-like articles. Such method includes providing a binding system having (a) a pair of covers and (b) a spine member having a cover-adhering strip divided into at least a first portion and a second portion. The articles and covers are edge-aligned and then held in such position during binding. A first portion of the strip is applied to a cover and the second portion is then applied to the same cover.

More specifically, the holding step includes grasping the covers with one hand and at least one of the applying steps includes applying a portion with the other hand. Typically, both applying steps include applying separate portions in sequence with the other hand. Or the holding step may include pressing the aligned articles and cover atop a flat surface with one hand. Then the portions are applied with the other hand.

Further details of the invention are set forth in the following detailed description and in the drawing.

BRIEF DESCRIPTION OF THE DRAWINGS

FIG. 1 is an isometric view of sheet-like articles, e.g., photographs, bound together using the inventive system.

FIG. 2 is a plan view of one cover of the system with one strip of a spine member adhering thereto.

FIG. 3 is an edge view of the cover and spine member of FIG. 2 taken along the viewing plane 3—3 thereof.

FIG. 6 is an elevation view of the system shown in conjunction with a stack of sheet-like articles being bound. Such FIGURE illustrates an alternate way of holding the system covers and articles during binding.

FIG. 7 shows the new system in conjunction with "long-edged" articles, e.g., document sheets, being bound.

FIG. 8 is an edge elevation view showing the system spine member in conjunction with articles being bound.

FIG. 9 is an isometric view of the binding system shown in conjunction with a stack of articles and a holding receptacle.

FIG. 10 is an isometric view of system spine members in end-to-end roll form on a dispenser.

DETAILED DESCRIPTION OF THE PREFERRED EMBODIMENTS

Figure 4:
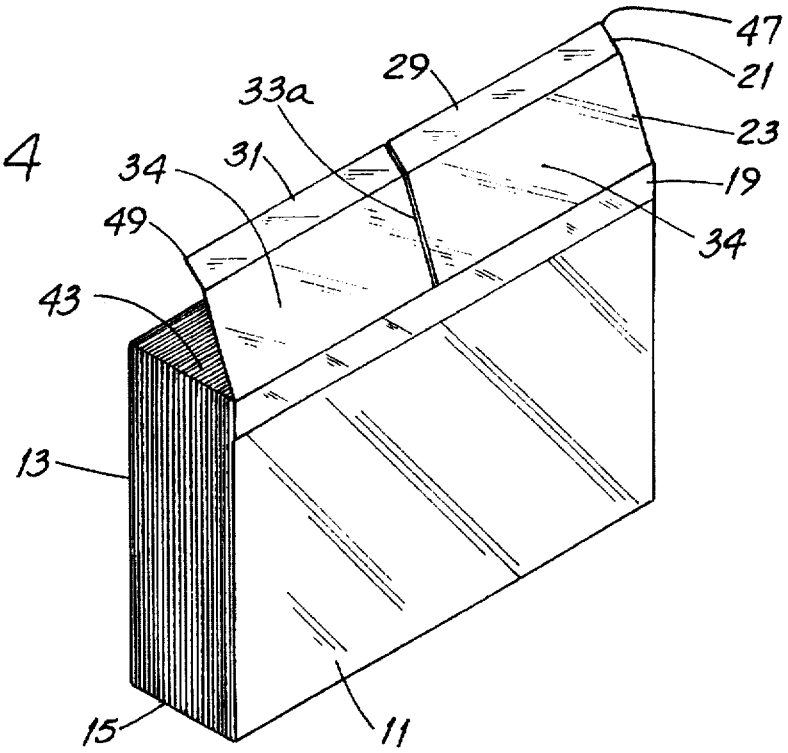
FIG. 4 is an isometric view of sheet-like articles in an intermediate stage of being bound together using the inventive system.

Before describing details of the inventive system 10 and method, it will be helpful to have an appreciation of how a set of articles appears when bound using such system 10. As shown in FIG. 1, the system 10 has a front cover 11 and a back cover 13 between which is placed a group of sheet-like articles 15. A strip-like spine member 17 adheres to both covers 11, 13 and to the articles 15 and binds them together "book-like" for easy article display. Because of features explained later in this specification, secure cover and article "stacking" is facilitated by the system 10 and the articles 15 are easy to remove from and replace in such system 10. As shown in FIGS. 2 and 3, the spine member 17 has a front cover-adhering strip 19 and a rear cover-adhering strip 21 spaced apart by a medial portion 23. When the system 10 is sold, one of the strips, e.g., strip 19, is preferably pre-attached to the corresponding cover 11 by adhesive. The medial portion 23 and the other strip 21 are covered by pressure-sensitive tape 25 overlaid by a release liner 27. Such liner 27 releasably adheres to the tape 25 and protects the spine member 17 from inadvertently sticking to some object other than the intended articles 15 and binder cover 13.

In the arrangement of the system 10, preferred from the standpoint of neatness and appearance, the front strip 19 is pre-applied to the front cover 11 and the medial portion 23 and rear strip 21 have tape 25 overlaid with a release liner 27. However, it is to be appreciated that the system 10 may be configured with the rear strip 21 pre-applied to the cover 13 and the portion 23 and front strip 19 covered by tape 25 overlaid with the liner 27.

As the articles 15 are being bound, the front strip 21 is that strip which is folded over to fully bind the stack of articles 15 between the covers 11, 13. As shown in FIGS. 1, 2, 4 and 5, such strip 21 is divided into at least two portions 29, 31 by one or more lateral cuts or slits 33 in the strip 21. Similarly, the medial portion 23 is divided by a slit **33*a* into at least two segments 34. In one embodiment, shown in FIG. 11, such lateral cuts or slits 33, 33a extend respectively through the thickness of the strip 21 and medial portion 23 only, i.e., not through the release liner 27. In another embodiment shown in FIG. 12, the lateral cuts or slits 33, 33*a* extend through the strip 21 and medial portion 23, respectively, as well as through the release liner 27**.

Figure 5:
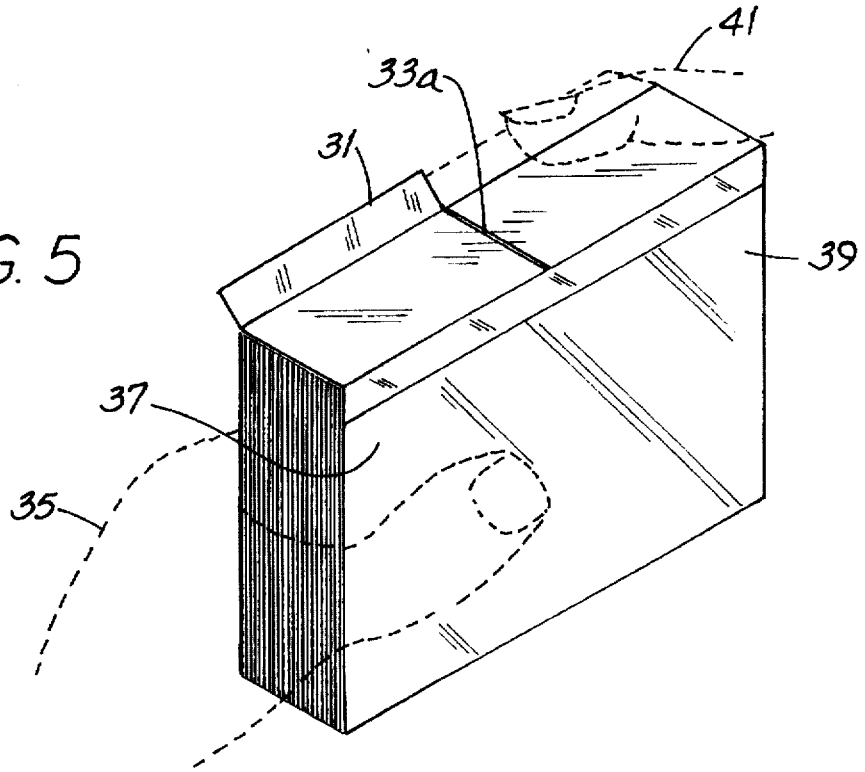
FIG. 5 is an isometric view of sheet-like articles in a more advanced stage of being bound together using the inventive system. The hands of the system user and a pre-application position of a strip portion are shown in dashed outline.
Figure 11:
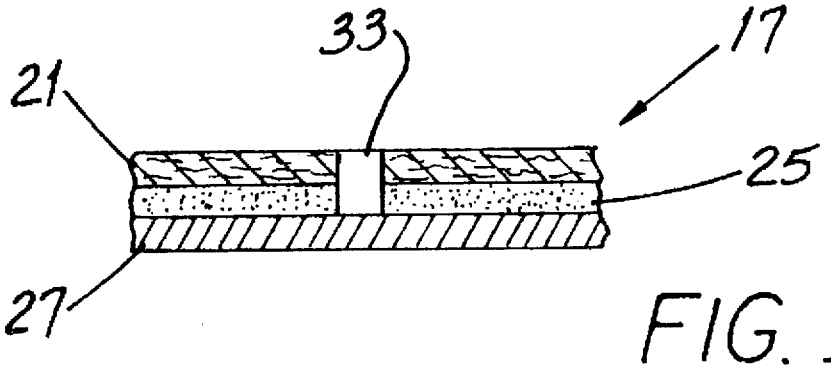
FIG. 11 is a cross-section view of one embodiment of a spine member having a release liner intact thereacross.

When using the spine member shown in FIG. 11, after placing the articles 15 between the covers 11, 13 and aligning the covers 11, 13 and articles 15 preparatory to final binding, a person using the system 10 may conveniently stand the resulting stack on edge as shown in FIG. 4. Referring also to FIG. 5, the person then grasps the aligned covers 11, 13 and articles 15 with one hand 35 at either of the upper corner locations 37 or 39 and holds them together. Using the other hand 41, the release liner 27 is pulled away and the segment 34 of the medial portion 23 is then folded toward and into adhering contact with the edges 43 of the articles 15. Then the corresponding portion, e.g., portion 29 is folded over and applied to the other cover 13. It is apparent from the foregoing that the user may elect to apply both segments 34 in sequence and then apply the portions 29, 31 in sequence to complete binding. When binding is complete, the spine member 17 adheres to and secures the articles 15 and the covers 11, 13 together.

Referring to FIG. 6, an alternate way to use the system 10 is to place the back cover 11 and articles 15 on a flat surface 45. While holding the cover 11 and articles 15 in alignment, the release liner 27 is removed and the medial portion 23 and strip portions 29, 31 are applied as described above.

Figure 12:
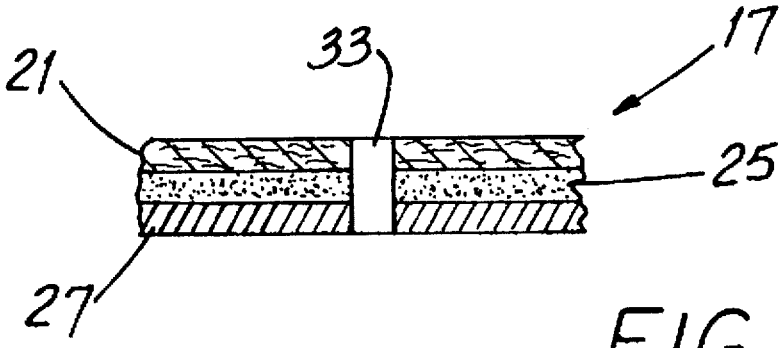
FIG. 12 is a cross-section view of another embodiment of a spine member having a release liner which is slit at one or more locations coincident with slit(s) in the spine member.

In an alternative embodiment shown in FIG. 12, the use of the system is similar to that described above. However, since the release liner 27 (as well as the strip 21 and medial portion 23) is divided into at least two portions, use of such a spine member requires the separate removal of each portion of the release liner. After the removal of one portion of the release liner, the corresponding segment 34 and portion 29 of the medial portion and strip can be folded over and adhered to the edges and the opposite cover, respectively. Another portion of the release liner can then be removed and the folding and adhering process repeated. This is done until the entire spine member is adhered and the documents are bound. Alternatively, all the portions of the release liner can be removed and the segments and portions of the strip and medial portion can then be folded and adhered.

The system 10 is particularly useful for binding candid photographs, postcards and the like. Such articles 15 have a standard size (or a few standard sizes) and for a given size have substantially the same dimension along an edge 43. The strip 21 has a pair of ends 47, 49 spaced apart by about the same dimension and for articles 15 of postcard or photo size, such strip 21 need only be divided into easily-applied portions 29, 31 by a single cut or slit 33 about midway between the ends 47, 49.

Referring now to FIG. 7, the system 10 is also very useful for binding articles 15 such as documents which are larger than photos or postcards and which have commonly-aligned edges 43. Such documents may be 8½ inches by 11 inches in size, for example. In that instance, the strip 21 is divided into at least three portions 29, 31, 51 or even four portions 29, 31, 51, 53 as appropriate for the articles 15. Such portions 29, 31, 51, 53 extend generally parallel to the edges 43 aligned for binding. In that way, each adhering portion 29, 31, 51, 53 is sufficiently short to be easily manageable with one hand 35 or 41. A portion length of about three inches is preferred.

A feature of the system 10 is shown in FIG. 8. Preferably, the medial portion 23 of the spine member 17 includes pressure-sensitive tape 25 which is relatively thick compared to the thickness of each of the articles 15 being bound. In that way, the edge 43 of an article 15 may be urged into the tape 25 to a slight depth and the tape 25 extrudes into the interstices 55 between article edges 43. In that way, each article 15 is well secured but, notwithstanding, each such article 15 may be easily withdrawn from the tape 25 so that such article 15 may be replaced with a different one.

Yet another feature of the invention relates to the way the articles 15 and covers 11, 13 are held. Referring next to FIG. 9, the system 10 may be used in conjunction with a slotted holding receptacle 57. The articles 15 and the covers 11, 13 are placed in the receptacle 57 and the medial segments 34 and portions 29, 31 applied as described above.

And the new spine member 17 may be made for very convenient, higher-volume use. Referring to FIG. 10, spine members 17 are attached to one another in end-abutting relationship and each spine member 17 is "delineated" from the adjacent spine member 17 by a score line 59. The members 17 are rolled up tape-like and mounted on a dispenser 61 much like a ticket dispenser for easy and immediate access.

Other aspects of the invention include a method for binding sheet-like articles 15. Such method includes providing a binding system 10 having (a) a pair of covers 11, 13 and (b) a spine member 17 having a cover-adhering strip 21 divided into at least a first portion 29 and a second portion 31. The covers 11, 13 are grasped with the articles 15 aligned and held between them. A first portion 29 of the strip 21 is applied to a cover 13 and the second portion 31 is then applied to the same cover 13.

More specifically, the grasping step includes grasping the covers 11, 13 with one hand 35 and at least one of the applying steps includes applying a portion 29 or 31 with the other hand 41. Typically, both applying steps include applying separate portions 29, 31 in sequence with the other hand 41.

The invention addresses and largely if not entirely eliminates the problem of trying to "lay down" a relatively long adhesive strip without inadvertently wrinkling or folding such strip. The invention permits a user to fold over relatively short—and much more manageable—strip portions 29, 31, 51, 53 in sequence. Each such strip portion 29, 31, 51 53 can be easily manipulated with one hand 35 while the other hand 41 holds the articles 15 to be bound and retains them in alignment.

While the principles of the invention have been described in connection with specific embodiments, it is to be understood clearly that such embodiments are by way of example and are not limiting.

What is claimed:

1. In an apparatus for binding articles and including a back cover, a front cover and a member for securing the articles and the covers together, the improvement wherein;

the member is a spine member that includes a medial portion between first and second parallel edges, a first cover-adhering strip along the first edge and a second cover-adhering strip along the second edge;

the medial portion and the first cover-adhering strip are each divided into at least two segment portions by at least one lateral cut that intersects only one of the edges; wherein the at least two segment portions can be sequentially bonded to the articles;

the articles each include a front surface, a back surface and an article edge; and the medial portion of the spine member extends along the article edges and includes adhesive tape which secures the articles only along substantially the entire length of each of the article edges while substantially avoiding contact between the spine member and the article front and back surfaces whereby the first cover-adhering strip attaches to the front cover and the second cover-adhering strip attaches to the back cover.

2. The apparatus of claim 1 wherein:

the articles are photographs and the article edge of each photograph has a dimension similar to the dimension of each other photograph article edge;

the medial portion has a pair of ends spaced apart by the dimension; and one of the at least one lateral cut is about midway between the ends.

3. The apparatus of claim 2 wherein:

the second cover-adhering strip has a release liner adhering thereto and having a length; and the length of the release liner is about equal to the dimension.

4. The apparatus of claim 3 wherein:

the release liner is divided into at least two liner portions, each liner portion being coextensive with a corresponding portion of the second cover-adhering strip.

5. The apparatus of claim 1 wherein:

the articles are documents, the article edges of which are aligned;

the medial portion of the spine member adheres to the article edges; and the medial portion is divided by plural lateral cuts into at least three segment portions extending generally parallel to the article edges.

* * * * *